US010618188B1

(12) United States Patent
Davis

(10) Patent No.: US 10,618,188 B1
(45) Date of Patent: Apr. 14, 2020

(54) UTILITY CUTTER WITH BLADE PAIR

(71) Applicant: Raymond E. Davis, Heath, TX (US)

(72) Inventor: Raymond E. Davis, Heath, TX (US)

( * ) Notice: Subject to any disclaimer, the term of this patent is extended or adjusted under 35 U.S.C. 154(b) by 0 days.

(21) Appl. No.: 16/117,022

(22) Filed: Aug. 30, 2018

(51) Int. Cl.
*B26B 3/00* (2006.01)
*B26B 29/06* (2006.01)
*B26B 1/10* (2006.01)
*B26B 1/08* (2006.01)

(52) U.S. Cl.
CPC ..... *B26B 29/06* (2013.01); *B26B 1/08* (2013.01); *B26B 1/10* (2013.01)

(58) Field of Classification Search
CPC .. B26B 29/06; B26B 1/08; B26B 1/10; B26B 27/005
USPC ..... 30/282, 2
See application file for complete search history.

(56) References Cited

U.S. PATENT DOCUMENTS 4,048,719 A * 9/1977 Thompson ..... B65B 69/0033 30/2
5,561,905 A * 10/1996 Sherman ..... B26B 27/00 30/280
5,890,290 A * 4/1999 Davis ..... B26B 5/003 30/162
7,870,675 B1 * 1/2011 Della Polla ..... B26B 29/00 30/2
8,869,408 B2 * 10/2014 Votolato ..... B67B 7/30 30/294
9,346,483 B2 * 5/2016 Davis ..... B26B 5/003
D767,966 S * 10/2016 Standlee ..... D8/98
9,650,065 B2 * 5/2017 Davis ..... B26B 5/003
10,137,588 B1 * 11/2018 Davis ..... B26B 29/02
10,315,317 B2 * 6/2019 Votolato ..... B26B 5/00
10,315,325 B2 * 6/2019 Votolato ..... B26B 5/00
10,391,655 B2 * 8/2019 Votolato ..... B26B 5/00
2002/0194734 A1 * 12/2002 Huang ..... B26B 3/08 30/2
2007/0245572 A1 * 10/2007 Ireland ..... B26B 5/005 30/294
2008/0016702 A1 * 1/2008 Domenico ..... B26B 3/08 30/294
2008/0250654 A1 * 10/2008 Chang ..... B26B 29/02 30/292
2010/0263219 A1 * 10/2010 Kempker ..... B25F 1/02 30/337
2010/0293796 A1 * 11/2010 Votolato ..... B26B 29/00 30/287
2013/0298409 A1 * 11/2013 Jacobs ..... B26B 9/00 30/314
2014/0298663 A1 * 10/2014 Horgan ..... B26B 25/007 30/292
2014/0345146 A1 * 11/2014 Schekalla ..... B26B 3/00 30/169

(Continued)

*Primary Examiner* — Omar Flores Sanchez
(74) *Attorney, Agent, or Firm* — Baker Law Firm; John Baker; Jeffrey Roddy

(57) ABSTRACT

A utility cutter includes a handle that includes a gripping surface; a blade slide including a blade pair is extendable from an opening of the handle; a guide coupled to each blade near a distal end of the blade opposite the proximal end, the guide including a contoured surface configured to engage a workpiece wherein a portion of the guide is pointed and configured to puncture the workpiece and another portion of the guide is configured to smoothly abut an underside of the workpiece once the guide has been inserted into the workpiece.

14 Claims, 7 Drawing Sheets

(56) References Cited

U.S. PATENT DOCUMENTS

| | | | | |
|---|---|---|---|---|
| 2015/0298330 | A1* | 10/2015 | Yu Chen | B26B 27/005 30/280 |
| 2016/0008991 | A1* | 1/2016 | Peppett | B26B 5/005 30/280 |
| 2016/0271818 | A1* | 9/2016 | Papiese | B26B 29/06 |
| 2017/0120469 | A1* | 5/2017 | Votolato | B26B 5/00 |
| 2018/0229386 | A1* | 8/2018 | Votolato | B26B 27/005 |
| 2018/0333870 | A1* | 11/2018 | Rus | B26B 5/006 |

* cited by examiner

UTILITY CUTTER WITH BLADE PAIR

CROSS-REFERENCE TO RELATED APPLICATIONS

None

TECHNICAL BACKGROUND

This disclosure relates to cutting rigid and semi-rigid materials.

BACKGROUND

Utility cutters may be used to cut or slice a variety of materials, such as cardboard, corrugated board of varying thickness, rubber, lightweight plastic, or other packaging material. In order to cut or slice such material, the utility cutter may need to have a sharpened blade. Certain precautions may be used to protect or help protect a user from the sharpened blade. For example, a utility cutter may include guards that extend from the cutter alongside the sharpened blade, such that the guards substantially prevent an accidental injury to the user or other bystander. Further, a utility cutter may include a protective handle that encloses substantially all of a blade during periods of non-use. Utility cutters, however, may be actuated accidentally even during periods of storage or non-use. Accidental actuation of a utility cutter, therefore, may present a substantial hazard to the user, other persons, or valuable material.

SUMMARY

In one general implementation, a utility cutter includes a handle that includes a gripping surface; a blade slide positioned in a recess of the handle that extends from an opening of the handle through a cavity within the handle; a blade pair coupled to the blade slide near a proximal end of the blade and extending through the recess and into the opening when the blade slide is in the retracted position; and a guide coupled to each blade near a distal end of the blade opposite the proximal end, the guide includes a contoured surface configured to engage a workpiece, such as to initially pierce the workpiece and may thereby bias the blade slide in an extended position such that the blade slide is extended from the opening of the handle, the blade slide biased to move from the extended position to the retracted position by a biasing member such as a spring.

In a first aspect combinable with the general implementation, the guide includes at least one pointed edge along the contoured surface, the pointed edge configured to pierce the workpiece.

A second aspect combinable with any of the previous aspects further includes a portion of the guide that may continually contact an underside; e.g., glide against the workpiece, when the cutter is drawn across the workpiece.

In a third aspect combinable with any of the previous aspects, one or more biasing members is in contact with the blade slide.

In a fourth aspect combinable with any of the previous aspects, at least one of the one or more biasing members is configured to exert a substantially constant force on the blade slide to bias the slide into the retracted position.

In a fifth aspect combinable with any of the previous aspects, at least one of the one or more biasing members includes a spring.

In a sixth aspect combinable with any of the previous aspects, at least one of the one or more biasing members is at least partially enclosed within the recess.

In a seventh aspect combinable with any of the previous aspects, each blade includes a cutting edge configured to engage the workpiece when the blade slide is in the extended position.

In a eighth aspect combinable with any of the previous aspects, the cutting edge includes at least a first cutting edge.

In a ninth aspect combinable with any of the previous aspects, the blade slide has a forward portion and a rearward portion.

In a tenth aspect combinable with any of the previous aspects, the blade pair is attached to the forward portion of the blade slide which is substantially exposed when the blade slide is in an extended position.

In a twelfth aspect combinable with any of the previous aspects, the forward portion of the blade slide includes sloped sides substantially parallel with a longitudinal side of the blades of the blade pair.

In a thirteenth aspect combinable with any of the previous aspects, the handle includes a slicing member.

In a fourteenth aspect combinable with any of the previous aspects, the blade includes titanium-coated carbon steel.

In another general implementation, a method for slicing a material includes extending a blade slide, engaging a first material with a guide coupled to a blade of a knife, the blade coupled to a blade slide biased to move the blade pair to a safe position substantially enclosed within a housing of the utility cutter; extending, through engagement of the first material with the guide, a blade of the blade pair a first distance away from the housing of the blade slide from the safe position to a first cutting position; engaging the first material with a blade of the blade pair to slice the first material; disengaging the blade from the first material; and based on disengagement of the blade from the first material, biasing the blade slide to move the blade from the first cutting position towards the safe position.

A first aspect combinable with the general implementation further includes engaging a second material with the guide, the second material including a different thickness than the first material.

A second aspect combinable with any of the previous aspects further includes extending, through engagement of the second material with the guide, a blade of the blade pair a second distance away from the housing of the utility cutter from the safe position to a second cutting position, the second distance different than the first distance.

A third aspect combinable with any of the previous aspects further includes engaging the second material with the blade to slice the second material; disengaging the blade from the second material; and based on disengagement of the blade from the second material, biasing the blade slide to move the blade from the second cutting position towards the safe position.

In a fourth aspect combinable with any of the previous aspects, the first and second distances are based on the relative thicknesses of the first and second materials.

In a fifth aspect combinable with any of the previous aspects, engaging a first material with a guide coupled to a blade of the blade pair includes engaging the first material with a pointed edge of the guide to penetrate the first material.

In a sixth aspect combinable with any of the previous aspects, biasing a blade of the blade pair to move the blade from the first cutting position towards the safe position includes urging the blade slide from the first cutting position towards the safe position by a spring.

In a seventh aspect combinable with any of the previous aspects, urging the blade slide from the first cutting position towards the safe position by a spring includes urging the blade slide from the first cutting position towards the safe position with a substantially constant spring force.

In an eighth aspect combinable with any of the previous aspects, urging the blade slide from the first cutting position towards the safe position by a spring includes urging the blade slide from the first cutting position towards the safe position without user action.

In a ninth aspect combinable with any of the previous aspects, engaging the first material with a blade of the blade pair to slice the first material includes slicing the first material in a first direction with a first cutting edge of the blade.

A tenth aspect combinable with any of the previous aspects further includes engaging the first material with a blade guide; extending, through engagement of the first material with the guide, the blade the first distance away from the housing of the utility cutter from the safe position to the first cutting position; and engaging the first material with the blade to slice the first material in a second direction different than the first direction with a second cutting edge of the blade.

An eleventh aspect combinable with any of the previous aspects further includes slicing a flexible material with a slicing edge of the housing of the utility cutter.

In another general implementation, a utility cutter includes a handle that includes a gripping surface and a face surface; a blade shuttle positioned in a recess of the handle that extends from an opening of the handle through a cavity within the handle; a blade pair coupled, at a proximal end, to the blade shuttle and extending through the recess and into the opening when the blade shuttle is in the retracted position; a guide coupled to a distal end of each blade opposite the proximal end and configured to penetrate a material; and a biasing member configured to urge the guide toward the face surface of the handle by biasing the blade shuttle toward the retracted position, the face surface and guide are separated by a gap 124 when the blade shuttle is in the retracted position, and, the utility cutter housing covers the cutting portion of each blade of the blade pair and the blade guide of each blade of the blade pair is exposed.

In a first aspect combinable with the general implementation, the gap is sized to receive a portion of the material when the blade shuttle is in the retracted position.

In a second aspect combinable with any of the previous aspects, the biasing member is configured to urge the guide against the portion of the material to compressibly contact the portion of the material between the guide and face surface of the utility cutter handle.

In another general implementation, a method includes receiving a material in a gap between a blade of a knife and a guide of the knife that is coupled to the blade near a proximal end of the blade, the blade coupled to a blade shuttle near a distal end of the blade; engaging the material with the blade of the knife; exerting a compressive force on the material by the guide and a surface of a handle of the utility cutter by biasing the guide toward the surface of the handle with a biasing member that exerts a force on the blade shuttle; and slicing the material with a cutting edge of the blade.

A first aspect combinable with the general implementation further includes engaging another material with the guide; extending, through engagement of the other material with the guide, the blade a distance away from the handle of the utility cutter greater than the gap; engaging the other material with the blade to slice the other material; disengaging the blade from the material; and based on disengagement of the blade from the material, biasing the blade slide to move into a retracted position where the guide is spaced apart from the utility cutter by the gap.

In a second aspect combinable with any of the previous aspects, the distance is based on a thicknesses of the other material.

In a third aspect combinable with any of the previous aspects, engaging another material with the guide includes engaging the other material with a pointed edge of the guide to penetrate the other material.

In a fourth aspect combinable with any of the previous aspects, biasing the blade shuttle to move into a retracted position includes biasing the blade shuttle to move into the retracted position without user action.

Various implementations of a utility cutter according to the present disclosure may include one or more of the following features. The utility cutter may provide for extension of a cutting blade from a housing based on engagement with the blade (or a guide attached to the blade) with a work piece, rather than based on any actuation initiated by a user. Thus, user action (e.g., pushing a blade from a housing through thumb action or a gripping action) may be decreased, thereby allowing the user to save energy, decrease injuries, and/or increase work output cutting or slicing the workpiece. As another example, the cutting blade may be covered (e.g., by a guide and/or cap) to protect the user from contact with the blade while still allowing full use of the cutter. As yet another example, the utility cutter may include automatic retraction of the blade (or a cutting edge portion of the blade) into a housing for safety when the blade is not in use (e.g., engaging a workpiece). The blade may be a replaceable blade as well, thereby being more cost effective. As another example, the cutter may be configured so that only a cutting edge of the blade engages the workpiece, thereby limiting a force necessary to cut the workpiece with the blade. The blades of the blade pair may be replaced, or the entire slide or shuttle with the blade pair may be replaceable. In such a case, the housing of the utility cutter may include a removable portion to access the blade shuttle.

In another general implementation, a utility cutter includes a handle that includes a gripping surface; one or more blades positioned in a recess of the handle that extends from an opening of the handle through a cavity within the handle; a guide coupled to the blade(s) near a distal end of the blade(s) opposite the proximal end, the guide including a contoured surface configured to engage a workpiece, the contoured surface having at least one pointed edge adapted for puncturing a surface and at least one non-cutting side, the guide further comprising a first ramped side (r) and a second ramped side, the first and second ramped sides directly adjacent the at least one pointed edge 120, the ramped sides transition to a widening of the guide 118, and the guide width at the attaching portion is greater than a thickness of the non-cutting portion (ncp) of the blade 116. In at least one aspect of the foregoing implementation, the guide has a fore portion that is pointed and an aft portion that is blunted. In another aspect, opposite ends of the guide may be sufficiently pointed to puncture packing boxes with ease, but insufficiently sharp to inadvertently puncture flesh. In yet another aspect of the foregoing implementation, the guide is non-detachable, being formed to a non-cutting portion (ncp) of the blade(s) by means of molding onto the blade or sintering of one or more metallic powders. In the foregoing general implementation, the blade(s) may be fixed in position, i.e., depth of cut, being molded integrally with the handle or, may be replaceable wherein some portions of the blade(s) are sandwiched between some portions of the handle. It should be understood that the features objects and aspects of the foregoing implementation may be combined with one or more of the various features objects and aspects of other implementations described herein.

Various implementations of a utility cutter according to the present disclosure may also include one or more of the following features. The utility cutter may not have a fixed depth of cut but may instead have a variable depth of cut. The depth of cut may be varied to a particular depth depending on a thickness of the material to be cut (e.g., single wall corrugated board, double wall corrugated board, triple wall corrugated board, or other material, like cellophane tape, or other adhesive material). The depth of cut may be determined by the cutter automatically or semi-automatically without additional action by the user beyond engagement of the material with the cutter. As another example, the cutter may allow for piercing of a material without blade engagement of the material to initiate a slice or cut, thereby reducing wear on the blade and possible injury to the user. In some implementations, the cutter may be made of washable material that reduces waste, dirt, and other materials from penetrating into an interior housing of the cutter.

Implementations of the utility cutter may contain a pair of fixed blades. The handle may envelope the cutting portions of the blades and the guides, e.g., FIGS. 1-6, or, the utility cutter handle may shield or envelope only the cutting portion of the blades, e.g., FIGS. 7-9.

These general and specific aspects may be implemented using a device, system or method, or any combinations of devices, systems, or methods. The details of one or more implementations are set forth in the accompanying drawings and the description. Other features, objects, and advantages will be apparent from the description and drawings, and from the claims.

LISTING OF THE REFERENCE NUMBERS

Figure 1:
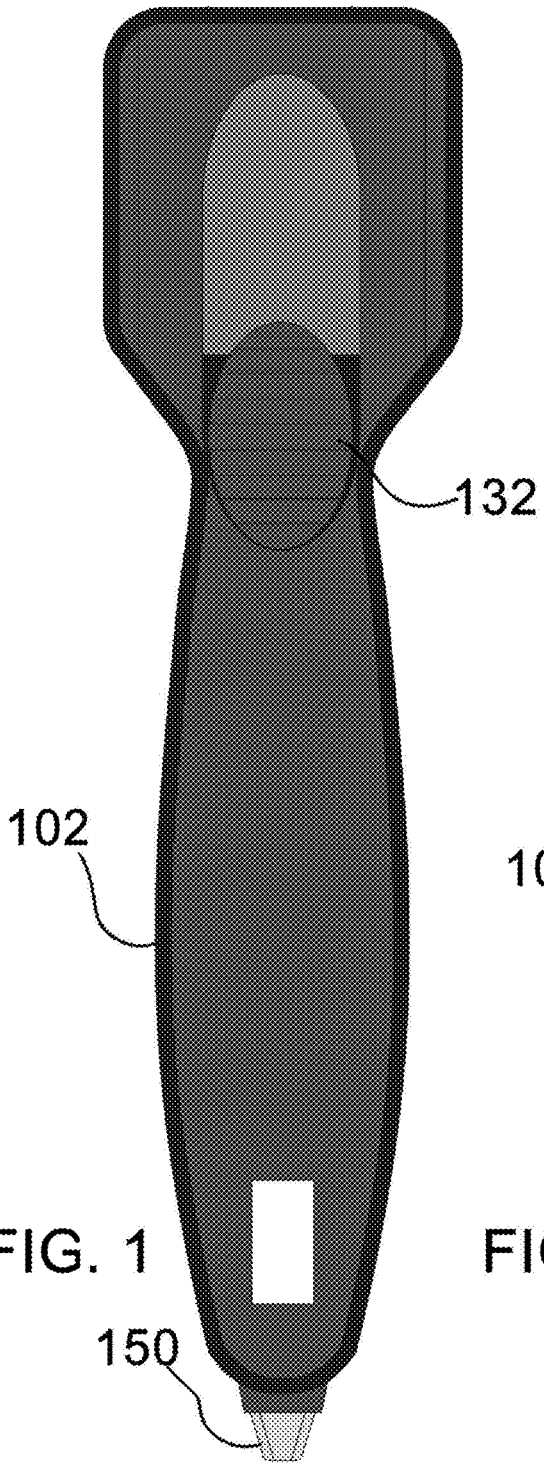
FIG. 1 is a diagrammatic external view of an implementation of a utility cutter with a pair of blades.

100 utility cutter
102 cutter handle
103, 105 sloped sides
106 opening
108 cavity/slide recess
110 blade slide/shuttle
112 blade slide face
113 cut-away
114 blade pair
116 blade
117 blade cutting edge
118 guide
120 pointed end
122 material abutting surface
124 gap
131 slide catch
132 thumb tab
134 thumb tab guide
140 biasing member
150 tape splitter
160 clip

DETAILED DESCRIPTION

The figures and following description illustrate and explain a utility cutter 100, which may be used to cut rigid or semi-rigid materials, such as, for example, corrugated board, cardboard or other paper products, rubber, plastic, Styrofoam, or any other appropriate material. The utility cutter 100 is typically a handheld device operated by either a left-handed or right-handed user with equal ease. In some implementations, the utility cutter 100 allows the user to carry, transport, or otherwise handle the cutter 100 in a safe position, whereby a sharpened blade 116 of the cutter 100 is enclosed or substantially enclosed within a protective housing or handle, and, an end of the blade 116 is capped with a guide 118 that includes pointed 120 and blunted portions. The user may, as appropriate, engage the cutter 100 into a material by engaging the guide 118 attached to the blade into the material. In some implementations, once engaged, the guide 118 may extend the blade 116 from a cavity 108 of the housing to expose a cutting edge 117 of the blade to the material. Once the user finishes cutting the material as desired, the user may disengage the blade 116 of the blade pair 114 and the guide 118 of the blade from the material. In some implementations with a blade that is movable with respect to a handle, once disengaged, the blade pair 114 may be automatically retracted within the protective handle by a biasing member 140 to ensure that the blade pair is no longer exposed and able to cause injury to the user or other person, and/or the material previously cut. This automatic retraction of the blade pair 114 may occur without any action taken by the user. In some implementations, only a portion of the cutting edge 117 of the blade 116 is exposed between the guide 118 and the handle 102.

With reference to FIGS. 1-9, an example implementation of a utility cutter 100 is shown in various views (e.g., side, end, and exploded) and in various positions (e.g., retracted and extended). As illustrated, the utility cutter 100 includes a handle (or housing) 102 that provides a gripping surface for a user of the utility cutter 100. In some aspects, the handle 102 may be manufactured to promote cleaning and sterilization of the utility cutter 100, such as, for example, through the use of non-corrosive materials (e.g., stainless steel, aluminum, plastic, or other non-corrosive and/or inert material) and/or with open contours substantially free from undercuts (e.g., to eliminate or partially eliminate material being trapped in or on the utility cutter 100). For example, in some aspects, the handle 102 (e.g., a solid, unibody structure) may be machine washable (e.g., through a dishwasher).

Handle 102 further includes an edge 150 or protrusion that extends along at least a portion of a contoured surface of the handle 102. The edge 150, in some implementations, may be sharpened (e.g., a 0.010 inch dull edge) relative to the contoured surface. Although the edge 150 may still be dull enough so as to prevent cutting or slicing of the user, the edge 150 may be sharp enough to slice through other flexible materials, such as, for example, cellophane tape or other packing tape that does not lend itself to efficient cutting with a sharpened blade (e.g., the blade 116).

Handle 102 may further include a clip 160 that includes an aperture through the handle 102 at a particular location. In FIG. 1, for example, the clip is positioned at an end of the handle opposite the blade slide 110. In some aspects, the clip may facilitate hanging the utility cutter 100 from, for example, a stationary structure such as a wall, as well as a user's belt or other clothing. The clip, therefore, may help the user find the utility cutter 100 and/or help prevent misplacement of the utility cutter 100.

Figure 2:
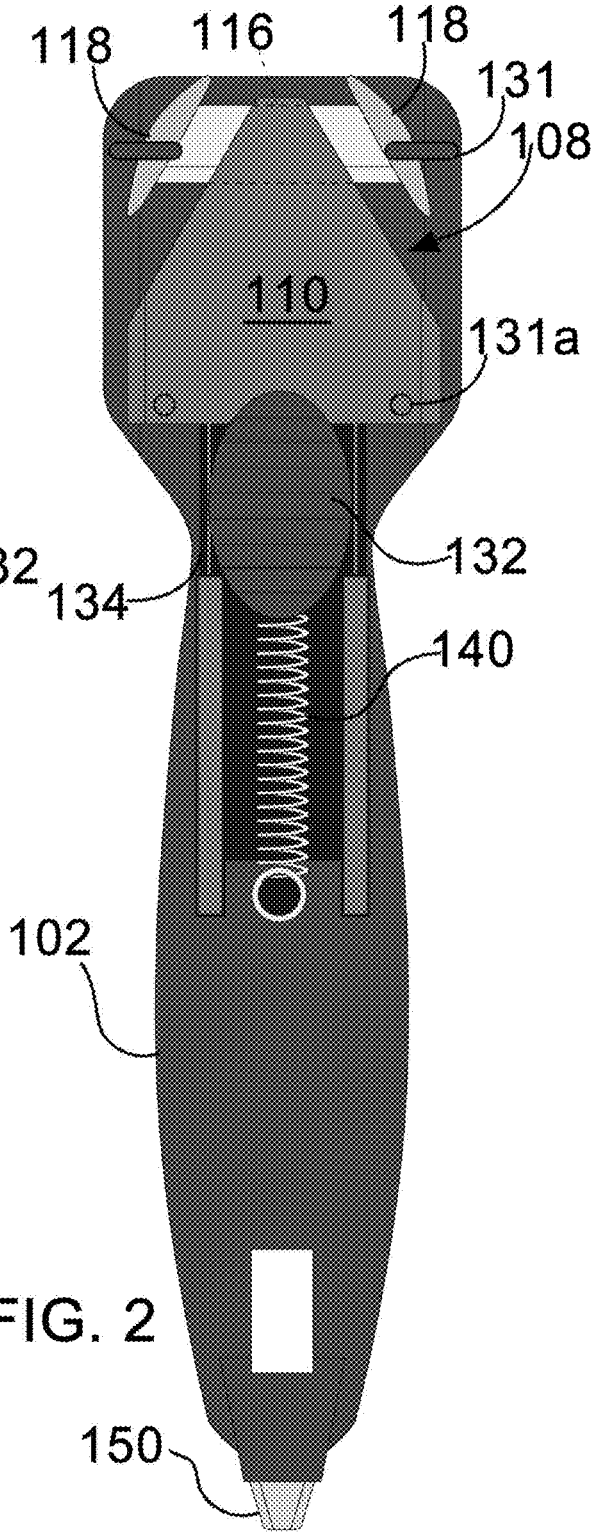
FIG. 2 is a diagrammatic cut-away view showing an internal spring retractable blade shuttle connected to the pair of blades.
Figure 3:
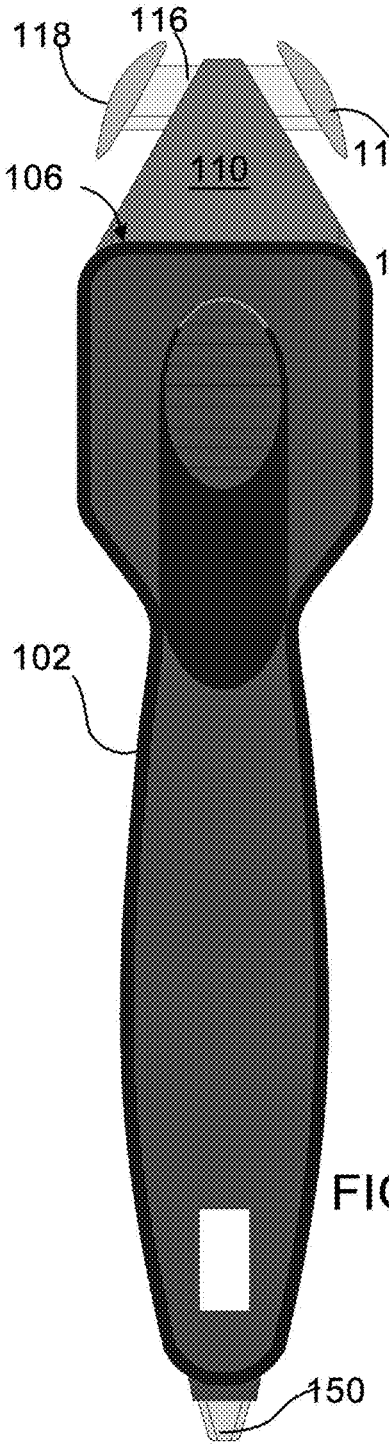
FIG. 3 is a diagrammatic external view of the implementation of (FIG. 1) with the blade shuttle and blade pair in an extended position.
Figure 4:
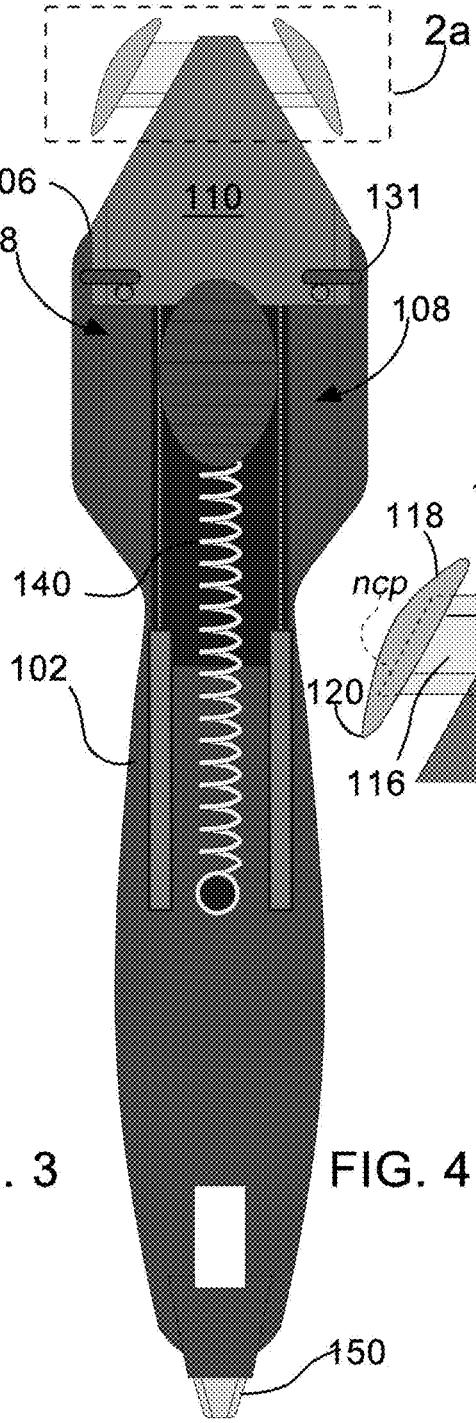
FIG. 4 is a diagrammatic cut-away view of the implementation of (FIG. 1) with the blade shuttle and blade pair in an extended position.

As depicted in FIGS. 1 and 2, the utility cutter 100 is shown in a retracted position in which all or most of the blade pair 114 is withdrawn into the handle 102. In FIG. 1, the blade 116 is illustrated as joined to a distal guide 118. In some aspects, in the retracted (or safe) position, the blade 116 may be enclosed within the handle 102 such that none of the blade slide 110 is visible outside of the handle 102. The implementation shown in FIGS. 1 and 2 show a handle that totally envelopes the cutting edge 117 of the blade and the blade guides 118 when the blade pair 114 is in the retracted position. The implementation shown in FIGS. 1 and 2 show a handle that totally envelopes the cutting edge 117 of the blade and the blade guides 118 when the blade pair 114 is in the retracted position. The implementation shown in FIGS. 3 and 4 show a handle that selectively envelopes only the cutting edge 117 of the blade, leaving the guide 118 exposed when the blade slide 110 and blade pair 114 are in the retracted position. In some implementations, the blade pair 114 is connected to a blade slide 110 similar to that shown in FIG. 4, and the blade slide is actuated manually by a thumb engaging surface or tab 132. In some implementations the blade slide 110 is connected to a biasing member 140 that may be a spring or an elastomeric band that automatically retracts the blade slide and the blade pair from the extended position when the tab is released unless the guide is engaged with a workpiece that is able to overcome the tension provided by the biasing member 140. It is also possible that the blade slide omit the biasing member and require manipulation to place the blade pair in both the extended and retracted positions.

As depicted in FIGS. 3 and 4, the utility cutter 100 is shown with blade slide in an extended position. Catches 131, such as projections formed into the cavity 108 may catch with portions 131*a* of the blade slide guide to arrest forward motion of the blade slide when actuated by sliding thumb tab 132.

Figure 7:
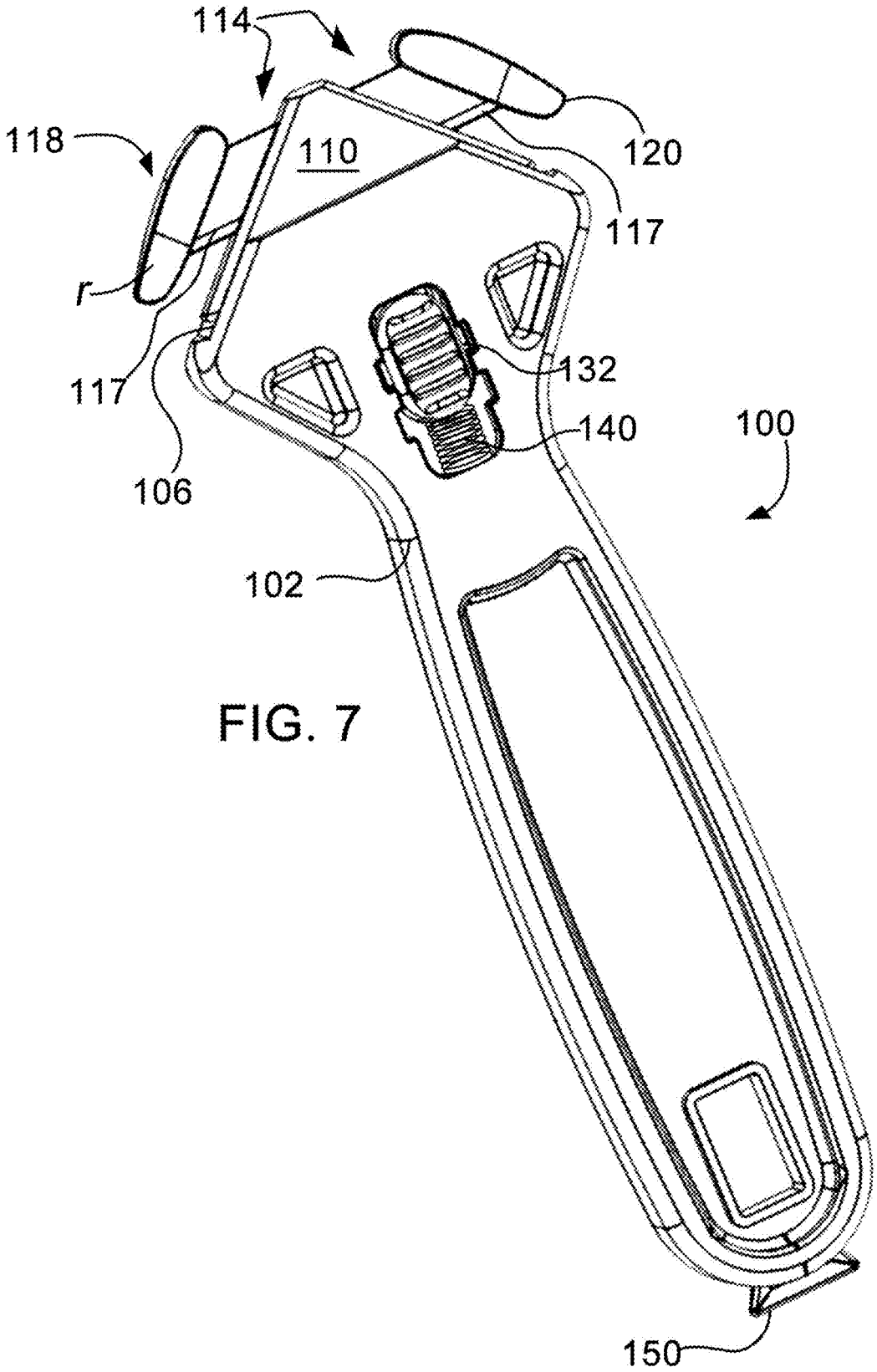
FIG. 7 is a perspective view of another implementation according to the present invention showing the blade pair 114 with blade guides 116 in an extended position.
Figure 8:
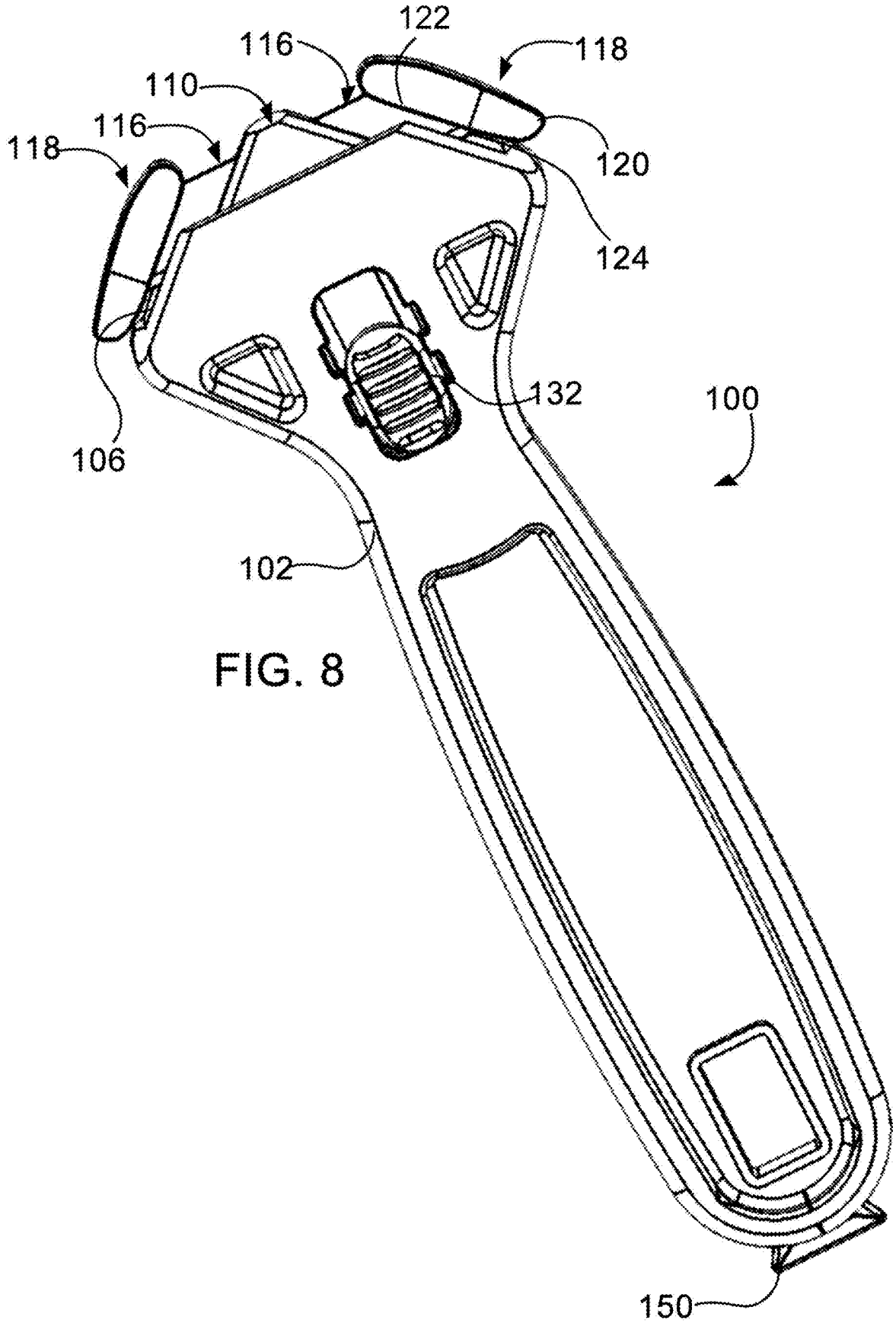
FIG. 8 is a partial cut-away view of the implementation of (FIG. 3) here shown with the blade pair 114 in a retracted and shielded position, and the blade guides 116 remain unshielded by the handle.
Figure 9:
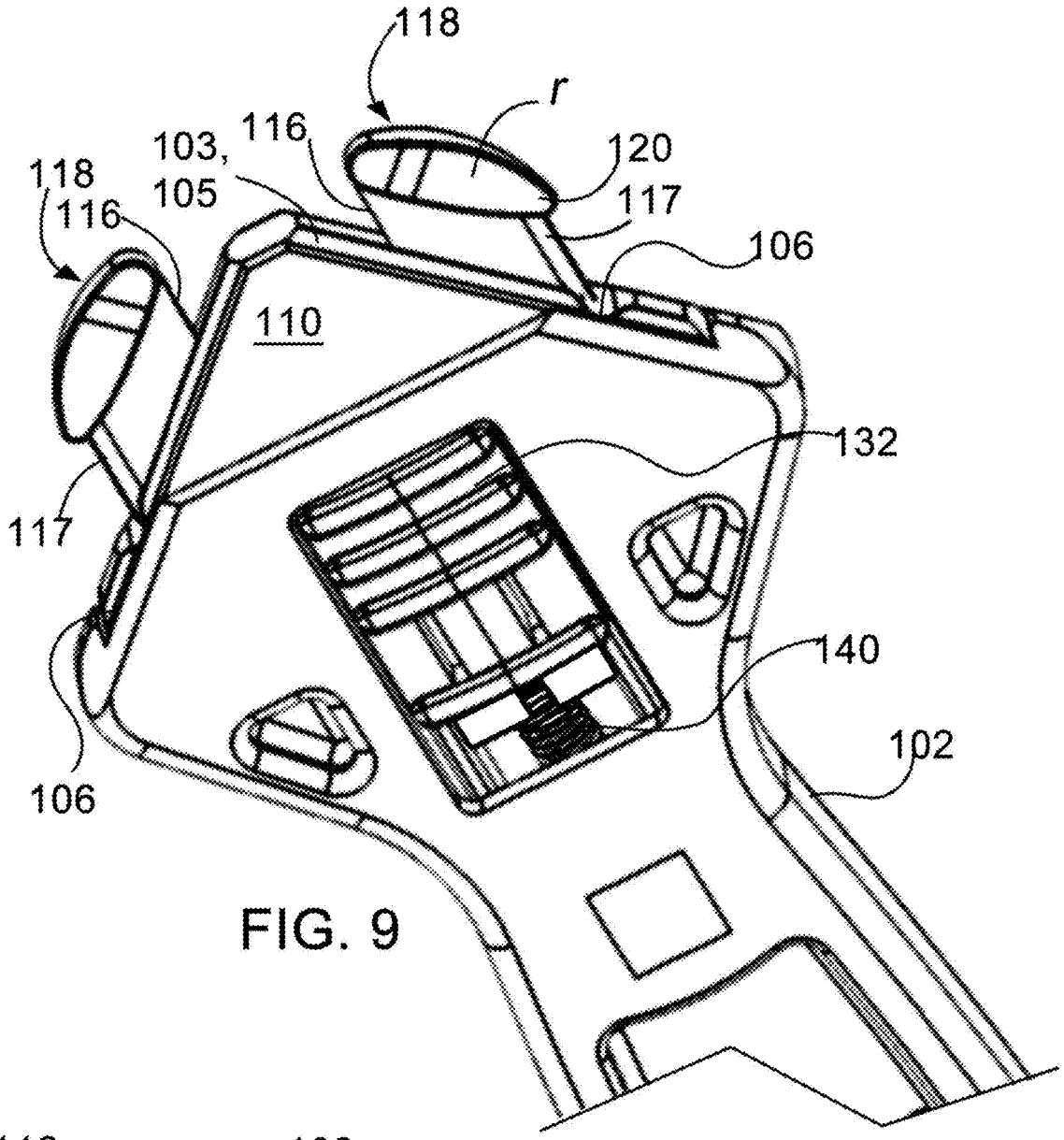
FIGS. 9 and 9A which are partial enlarged detail views show yet another implementation operationally similar to that shown in (FIGS. 3-9), with the blades of the blade pair 114 having an in-line disposition relative to the handle 102.
Figure 9A:
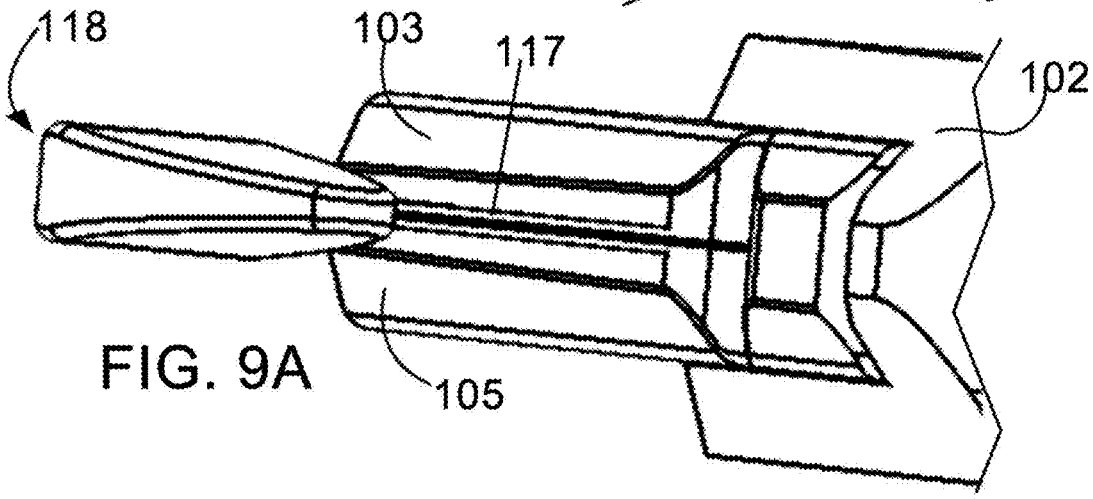

In some implementations such as those shown in FIGS. 7-9, while the blade slide is substantially hidden within a cavity 108 of the handle 102 when in the retracted position, the blade guide 118 may still be exposed and reside flush against the handle—or, a gap (e.g., 1/16 inch) may exist between the guide 118 and portions of the handle 102. Based on the gap 124, for instance, the utility cutter 100 may be operable to cut or slice various materials (e.g., cellophane tape, straps, rope, cords, and otherwise) that fit within the gap. While the blade slide structure covered by handle 102 of the implementations shown in FIGS. 5-8 is not itself shown, it is generally similar to that shown in the diagrammatic depictions of FIGS. 2 and 4. Typically, the blade slide is molded to slide linearly within handle 102 and to partially exit opening 106 when the thumb tab is moved forward. Persons having ordinary skill in the art will appreciate a variety of configurations suitable for use as a blade slide. Portions of the blade slide may contact portions of the blade slide cavity such as prongs or detents that will arrest the forward motion of the blade slide such that only a forward portion of the blade slide is exposed when the blade slide is in the extended position. U.S. Pat. No. 9,650,065 by the same inventor, shows and describes various blade slides/shuttles, the general operating principles of which may be employed with the instant invention, and is hereby incorporated by reference.

The blades of the blade pair may be disposed substantially transverse the handle (FIGS. 1-8) or, the blades of the blade pair may be disposed in a position substantially parallel; e.g., (FIG. 9), with the longitudinal axis of handle 102.

In some implementations, guide 118 is coupled to (e.g., permanently or semi-permanently) or integral with the blade 116. The guide 118 includes a ramp angle that terminates in points 120 (e.g., dull points of 0.005 inch) on either end of the guide 118. The guide points 120 may be configured to pierce a material so as to provide an initial cut through which the blade 116 may extend to begin further cutting or slicing. Further, the guide 118, and in some aspects the points 120 specifically, may provide for a catch that, when engaged with a material, forcibly extends the blade 118 from the handle 102 (as described below).

Moving again to FIG. 2, the blade slide 110 extends into the recess (or cavity) 108. In some aspects, the blades 116 may be integral with the blade slide 110, thereby requiring replacement of the slide and the blade pair when the blades 116 become dull. It is possible however that in some implementations, blade 116 alone may be replaced by slipping the blade 116 from a nesting portion of the blade slide. In some aspects, a single blade member may provide two opposite cutting portions 117 at opposite distal ends of the single blade member (also termed blade) In some aspects, the blade 116 may be made of carbon steel and coated with titanium to improve wear resistance and blade life. In some implementations, the blade 116 is not replaceable and utility cutter is disposed after the blades lose sharpness.

Figure 2A:
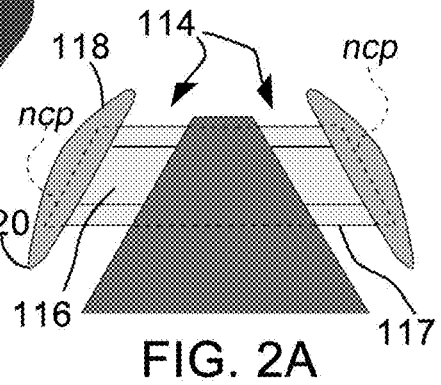
FIG. 2A is an enlarged detail view of call-out (2*a*) in (FIG. 4) that shows an exemplary blade.
Figure 5:
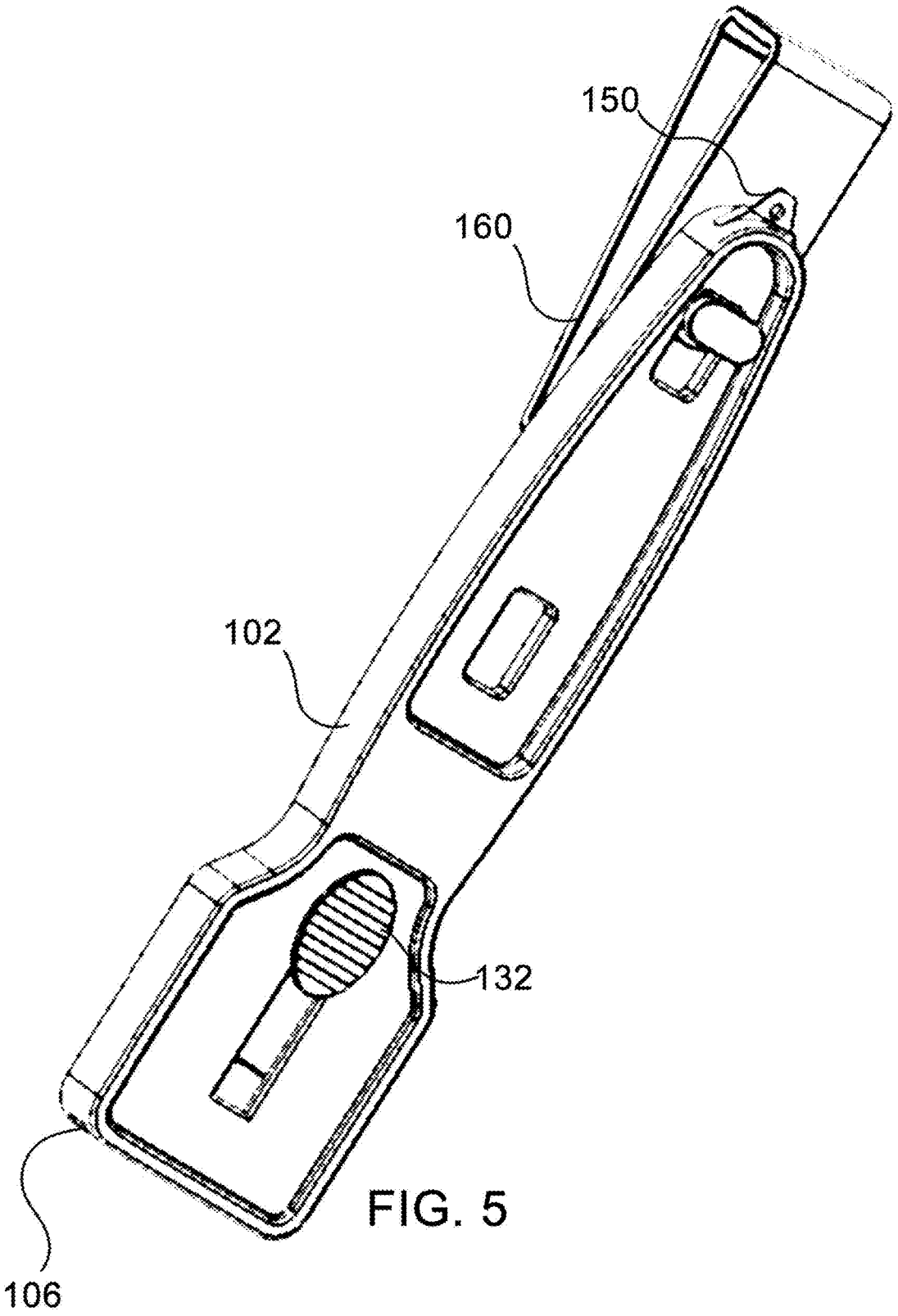
FIG. 5 is a perspective view of an implementation similar to that shown in (FIGS. 1-4) according to the present invention, which includes retractable dual blades, and shows the blade pair and blade guides 116 in a retracted position.
Figure 6:
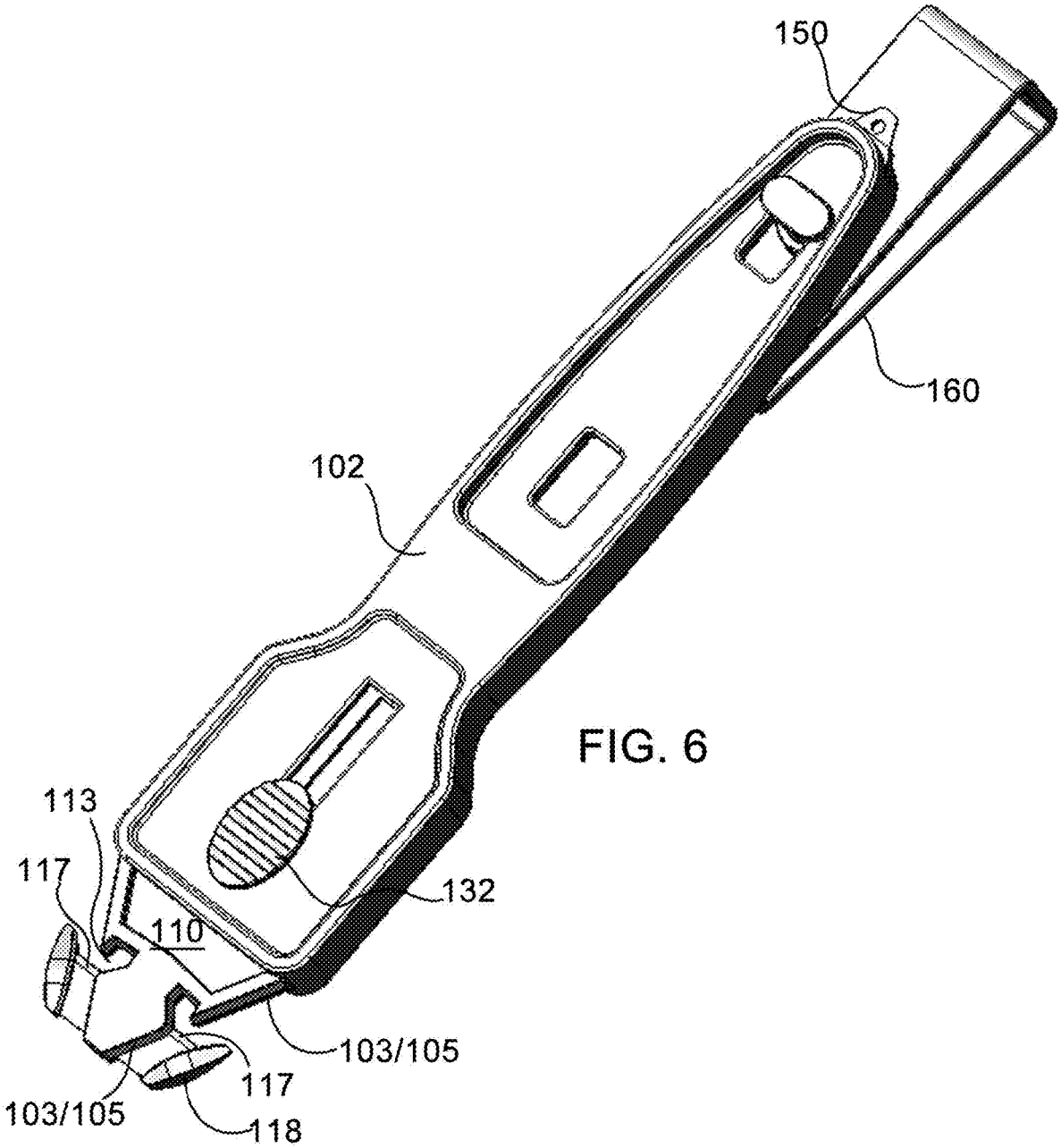
FIG. 6 is a view of the implementation of (FIG. 5) here shown with the blade pair and blade guides 116 in an extended position.

As depicted in enlarged detail FIG. 2A, blade 116 may include cutting edges 117 located on two sides (opposed) of the blade 116. Multiple cutting edges 117 may provide for both "pull" and "push" cutting or slicing without the user having to rotate the utility cutter 100 relative to the material being engaged. Further, multiple cutting edges 117 may provide for an extended life of the blade 116 and less wear on the blade 116. In alternative implementations, the blade 116 may include only a single cutting edge 117.

In any of the various implementations, blade slide 110 may include angled surfaces 103 and 105 that are located on either side of the blade 116. In some aspects, the angled surfaces may define (or help define) an angle of cut of the blade 116 into and/or through a material (e.g., corrugated board or other material). For example, in some aspects, the surfaces 103 and 105 define a cutting table area, with a drop-off (e.g., about 105 degrees but may be other angles) relative to the flat side of the blade 116*a* on each side of the blade 116. The drop-off on each side of the blade 116 may provide for a compound angle of cut for improved wear and with less resistance of cut.

In the implementations depicted in FIGS. 7-9, as the guide 118 engages the material, and in some aspects, penetrates the material with the point 120 of the guide 118, the blade 116 is extended from the cavity 108 into an extended or cutting position. This may be accomplished by simply puncturing the workpiece and drawing the utility cutter handle slightly away, leaving the guide and blade engaged with the workpiece. For example, the blade 116 is extended as a frictional force between the guide 118 and material overcomes a force exerted on the blade slide 110 by the biasing member 140. For instance, the frictional force or contact force between the guide 118 and material is directed opposite of the biasing force exerted on the blade slide 110 and extends the blade 116 so that a cutting edge 117 engages the material. In the example implementation, therefore, extension of the blade 116 may occur without user action to extend the blade slide 110 and thus the blade 116 from the retracted position, and extension of the blade 116 may occur, in some aspects, solely through contact between the guide 118 and the workpiece.

The material of the workpiece may be of varying thickness or, in some aspects, operation of the utility cutter 100 may occur on various materials of different thicknesses. In some aspects, the extended or cutting position, and the distance the blade 116 is extended from the handle 102, may depend on the thickness of the material engaged with the guide 118. For instance, as the guide 118 engages (e.g., penetrates through) a relatively thin material, such as single wall corrugated board, the force generated to extend the blade 116 from the cavity 108 may be sufficient to extend the blade 116 just enough to cut or slice the single wall corrugated board. But as the guide 118 engages (e.g., penetrates through) a thicker material, such as double or triple wall corrugated board, the force generated to extend the blade 116 from the cavity 108 may be sufficient to extend the blade 116 enough to cut or slice the thicker material. As the blade 116 cuts or slices the material, the thicker the material, the greater a frictional force between the material and blade 116 may be generated to maintain the blade 116 extended from the handle 102. Thus, the utility cutter 100 may include a variable depth of cut of the blade 116 that conforms to a necessary depth depending on the material thickness without any necessary action to be taken on the part of the user.

Once engaged with the material, the cutting edge 117 may slice or cut the material as necessary. As described above, with a blade 116 that includes two cutting edges 117, slices or cuts may be made bi-directionally in the material. During slicing or cutting, the guide 118 may separate the blade 116 from, for example, a product stored inside of a container made of the material. Thus, clearance is created between the product and the blade 116, preventing product damage.

When the slice or cut is completed, the user may pull the blade 116 from the material, and the guide 118 may disengage the material. Once disengaged, the blade slide 110 may be biased by the biasing members 140 to retract the blade 116 into the safe position inside the handle 102.

Regarding the geometry of the blade 116 and sloped adjacent regions (103, 105) of the blade slide 110, each guide 118 is configured to pierce the work providing an opening for the remainder of the blade edge to follow. More specifically, the pointed end of the guide expands to 5 times the thickness at the opposite end. The length of the guide serves to separate the blade from product inside the box. The thin front penetrating point 120 and the blade thickness/width provide the cutter the ability to cut and separate the cardboard from the product inside by actually pulling the blade outward while cutting the cardboard using the guide to protect the product inside. The blade is positioned on the handle to allow the blade closest to the body of the cutter to make contact with the cardboard being cut first by using a 20 degree cutting surface with the actual blade angled back. A second cutting angle is built into the body of the blade slide adding the second angle of 15 degrees to reduce the energy required to cut the cardboard. This angle is tipping the blade up 15 degrees. A third cutting angle is the protrusion of the blade from the holder at 20 degrees allowing the blade to cut in a scissor like fashion on the box making the actual cut now an obtuse cutting angle increasing the life of the blade. The sloping sides 103, 105 permit a user to lean the handle to either side as much as 30 degrees and as little as 20 degrees from vertical when drawing the cutter to expose more of the cutting edge of the workpiece. In some implementations; e.g., FIG. 6, cut away sections 113 in front of the cutting edges 117 of the blades 116 permit bunching stock to be temporarily relieved into the sections during a cutting stroke as a way of providing uninterrupted cutting when cutting irregular cardboard or uneven corrugated stock.

A number of implementations have been described. Nevertheless, it will be understood that various modifications may be made. Accordingly, other implementations are within the scope of the following claims.

What is claimed is:

1. A utility cutter, comprising:

a handle that comprises a gripping surface;

a pair of blades configured to extend from the handle, each blade of the pair of blades comprising a cutting portion which includes one or more cutting edges and a non-cutting portion including a thickness; and a guide including a guide length in a direction substantially parallel with the non-cutting portion of each blade and a guide width in a direction substantially transverse the guide length;

the guide attached directly and fixedly to each blade independent of engaging contact between the guide and the handle, the guide positioned in an attaching position on each blade to expose at least a portion of the cutting portion and cover at least a portion of the non cutting portion, the guide comprising a contoured surface that comprises at least one pointed edge to pierce through a corrugated material, the guide further comprising a first ramped side and a second ramped side, the first and second ramped sides directly adjacent the at least one pointed edge, the ramped sides transition to a widening of the guide, and the guide width at the attaching portion is greater than the thickness of the non-cutting portion of each blade;

the utility cutter further comprises a movable blade slide connected to the pair of blades, the blade slide including at least a blade pair extended position and a blade pair retracted position, the movable blade slide is substantially exposed when the blade slide is in the blade pair extended position.

2. The utility cutter of claim 1, wherein the guide is semi-permanently or permanently attached to the blade.

3. The utility cutter of claim 1, wherein the handle is adapted to envelope at least the cutting portion of each blade when the blade slide is in a retracted position.

4. The utility cutter of claim 1, wherein the guide comprises a non-cutting surface adjacent the at least one pointed edge.

5. The utility cutter of claim 1, wherein the pointed edge is configured to engage a material.

6. The utility cutter of claim 1, wherein the pointed edge is configured to pierce a corrugated material.

7. The utility cutter of claim 1, wherein the pointed edge is configured to pierce a corrugated material and shield the cutting portion of the blade from a product contained in the corrugated material.

8. The utility cutter of claim 1, further comprising a biasing member connected to the blade slide.

9. The utility cutter of claim 1, wherein the blade slide or handle further comprises sloped sections sloping away from either side of the blade.

10. The utility cutter of claim 1, wherein the pair of blades are on a single blade slide and medially separated by portions of the blade slide.

11. The utility cutter according to claim 1, further comprising sloped sides substantially parallel with a flat side of the blades, and wherein the angle between the flat side of the blade and at least one of the sloping sides is between 100 and 120 degrees.

12. The utility cutter according to claim 1, further comprising sloped sides substantially parallel with a flat side of the blades, and wherein the angle between the flat side of the blade and at least one of the sloping sides is between 105 and 115 degrees.

13. The utility cutter according to claim 1, further comprising a mounting angle between a leading edge of the cutting edge of the blades and the handle body of between 110 and 130 degrees.

14. The utility cutter of claim 1, wherein the guide portion of the at least one blade is a sintered form.

* * * * *